US005362382A

United States Patent [19]

Heck et al.

[11] Patent Number: 5,362,382

[45] Date of Patent: Nov. 8, 1994

[54] RESID HYDROCRACKING USING DISPERSED METAL CATALYSTS

[75] Inventors: Roland H. Heck, Pennington; Frank T. DiGuiseppi, Yardville, both of N.J.

[73] Assignee: Mobil Oil Corporation, Fairfax, Va.

[21] Appl. No.: 720,106

[22] Filed: Jun. 24, 1991

[51] Int. Cl.[5] ..... C10G 45/00

[52] U.S. Cl. ..... 208/210; 208/212; 208/59; 208/89; 208/251 H; 208/96; 208/303

[58] Field of Search ..... 208/59, 251 H, 254 H, 208/210, 89, 309, 303

[56] References Cited

U.S. PATENT DOCUMENTS

| | | | |
|---|---|---|---|
| 1,876,270 | 9/1932 | Zorn | 208/108 |
| 3,161,585 | 12/1964 | Gleim et al. | 208/264 |
| 3,622,495 | 11/1971 | Gatsis | 208/251 H |
| 4,111,787 | 9/1978 | Aldridge et al. | 208/10 |
| 4,151,070 | 4/1979 | Allan et al. | 208/251 H |
| 4,192,735 | 3/1980 | Aldridge et al. | 208/112 |
| 4,243,519 | 1/1981 | Schorfheide | 208/59 |
| 4,344,840 | 8/1982 | Kunesh | 208/59 |
| 4,492,624 | 1/1985 | Johnson et al. | 208/130 |
| 4,708,784 | 11/1987 | Howell et al. | 208/112 |
| 4,724,069 | 2/1988 | Aldag, Jr. et al. | 208/251 H |
| 4,728,417 | 3/1988 | Aldag, Jr. et al. | 208/254 H |
| 4,729,826 | 3/1988 | Lindsay et al. | 208/251 H |
| 4,747,936 | 5/1988 | Penning | 208/309 |
| 4,761,220 | 8/1988 | Beret et al. | 208/59 |
| 4,801,373 | 1/1989 | Corman et al. | 208/210 |
| 4,954,241 | 9/1990 | Kukes et al. | 208/59 |
| 5,013,427 | 5/1991 | Mosby et al. | 208/251 H |
| 5,124,025 | 6/1992 | Kolstad et al. | 208/254 H |
| 5,242,578 | 9/1993 | Taylor et al. | 208/309 |

*Primary Examiner*—Helane Myers

*Attorney, Agent, or Firm*—A. J. McKillop; M. D. Keen

[57] ABSTRACT

Heavy oils are advantageously preconditioned by heat soaking prior to hydrotreating with a dispersed metal catalyst to reduce coking in a two stage hydrotreating process. The effluent of a hydrotreating process is filtered to recover catalytically active coke which is recovered by backflushing and recycled to the feed stream. A mild solvent deasphalting step isolates metals in a reduced volume asphaltene fraction.

21 Claims, 5 Drawing Sheets

RESID HYDROCRACKING USING DISPERSED METAL CATALYSTS

BACKGROUND OF THE INVENTION

1. Field of the Invention

This invention relates to the hydrotreating of heavy hydrocarbon oil fractions to produce a product containing lighter hydrocarbon components with lower metals content.

2. Background of the Art

It is well known to hydrotreat heavy hydrocarbon oils such as petroleum residue to convert such heavy oils to lighter products and to remove contaminants such as metals, sulfur and nitrogen. Hydrotreating is generally performed in the presence of a catalyst. The reactor may contain the catalyst in a fixed or fluidized bed, or, alternatively, the catalyst may be dispersed in the heavy oil and fed along with the feedstock through a reactor which provides the appropriate residence time at a temperature necessary for the desired conversion.

Metal contaminants may deposit on the catalyst of a fixed bed and deactivate it after a period of time thereby requiring shutdown of the reactor and replacement or regeneration of the catalyst. For treatment of heavy oils containing a high content of contaminant metals a process based on dispersed catalyst may be preferred. The dispersed catalyst, which may be a metal organic compound, must be continuously added to the feed.

A difficulty in employing catalytic hydrotreating at moderate hydrogen pressure (i.e., less than about 2500 psig) is that efforts to achieve high conversion can result in the formation of excessive amounts of coke (i.e., greater than about 1 to 2 wt. %) which can deposit inside the reactor and impair continuous operation of the unit. Operating the reactor at lower temperatures (i.e., less than about 750° F.) can reduce coking but achieves low conversion and requires very long residence times. Higher operating temperatures (i.e., greater than about 820° F.) permit shorter residence times but yield too much coke at high conversion.

Crude petroleum oils, as well as the heavier hydrocarbon fractions derived therefrom, generally contain metallic contaminants which have an adverse effect on catalysts utilized in various processes to which the crude oil, or heavy hydrocarbon fraction thereof, is ultimately subjected. The most common metallic contaminants are nickel and vanadium, although other metals including iron, copper, etc., are often present. These metals occur in a variety of forms. They may exist as metal oxides or sulfides introduced into the crude oil as metallic scale or similar particles, or they may be present in the form of soluble salts of such metals. Usually, however, they exist in the form of stable organometallic compounds such as metal porphyrins and the various derivatives thereof. Although the metallic contaminants existing as oxide or sulfide scale may be removed, at least in part, by relatively simple filtering techniques, and the water-soluble salts are, at least in part, removable by washing and subsequent dehydration, a more severe treatment is required to remove the stable organometallic compounds, such as metal porphyrins, before the crude oil or heavy hydrocarbon fraction thereof is suitable for further processing. Notwithstanding that the concentration of these organometallic compounds is relatively small, for example, often less than about 10 ppm calculated as the elemental metal, subsequent processing techniques are adversely affected thereby. For example, when a hydrocarbon charge stock containing metals in excess of about 3.0 ppm is subjected to catalytic cracking, the metals become deposited upon the catalyst, altering the composition thereof to the extent that undesirable by-products are formed. That is to say, the composition of the catalyst composite, which is closely controlled with respect to the nature of the charge stock being processed and the quality and quantity of the product desired, is considerably changed as a result of the metal deposition thereon during the course of the cracking process. As a consequence, the liquid product recovery is reduced, and coke and hydrogen are formed in excessive amounts, the former producing relatively rapid catalyst deactivation. The presence of stable organometallic compounds, including metal porphyrins, adversely effects other processes including catalytic reforming, isomerization, hydrodealkylation, etc.

In addition, crude petroleum oils, and the heavier hydrocarbon fractions thereof, generally contain undesirable nitrogenous and sulfurous compounds which may be removed from the petroleum oil by hydrotreating wherein these compounds are converted respectively to ammonia and hydrogen sulfide which are readily separated from the system in a gaseous phase. However, reduction in the concentration of the stable organometallic compounds, to the extent that the crude oil or heavy hydrocarbon fraction thereof becomes suitable for further processing, is not as readily achieved.

The crude oils and other heavy hydrocarbon fractions generally contain considerable quantities of pentane-insoluble materials present in the form of a colloidal suspension or dispersion. These pentane-insoluble materials, described as asphaltenes, are a carbonaceous material considered as coke precursors having a tendency to become deposited as a gummy hydrocarbonaceous residue. The asphaltenes contain the bulk of the difficult to remove metal contaminants.

SUMMARY OF THE INVENTION

The present invention in its various aspects overcomes the difficulties mentioned above.

The present invention is a process for hydrotreating a heavy oil fraction such as petroleum residue by dispersing a catalyst within the heavy oil to create a hydrotreating feedstock.

In one embodiment of the present invention the feedstock is preconditioned under relatively mild hydrotreating conditions in a first stage hydrotreating operation, the resulting preconditioned oil thereafter being hydrotreated under relatively severe hydrotreating conditions in a second stage hydrotreating operation to provide the fully hydrotreated oil product. This two-stage hydrotreating process has been found to result in significantly less overall coking than that occurring in a single stage hydrotreating process which achieves equivalent severity.

In another embodiment of the present invention the effluent from the second stage hydrotreating operation is filtered to remove particles containing coke and catalyst. The filters are backflushed with a flush oil which is then recycled to the feedstock along with the particles of coke and catalyst.

In an alternative embodiment the aforementioned hydrotreated effluent is fractionated to separate a residue fraction which is then subjected to mild solvent deasphalting, preferably with a paraffinic solvent to render the asphaltene fraction insoluble. The asphaltene fraction, which carries most of the metal contaminants, is readily separated and may be burned or otherwise disposed of. The metals can be recovered from the ash remaining after incineration. The solvent fraction containing purified petroleum residue fraction can be sent on to further processing.

DETAILED DESCRIPTION OF PREFERRED EMBODIMENTS

Figure 1:
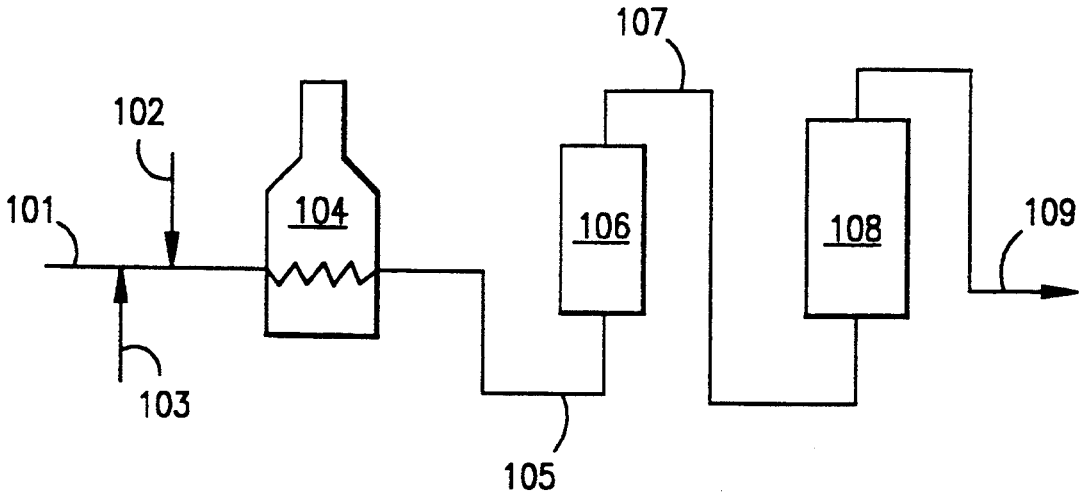
FIG. 1 is a flow chart illustrating the two-stage hydrotreating process of the present invention.

Petroleum residue is converted to lighter hydrocarbons by hydrotreating, which involves exothermic hydrocracking reactions. A dispersed metallic catalyst such as molybdenum, nickel, vanadium, etc. is used in the method of the present invention. Non-limiting examples of suitable hydrocarbon containing feeds for the present invention include heavy crude oils, petroleum residues, heavy coal oil, tar oil, or shale oil fractions. Preferred feeds include full range crudes (untopped) and topped crudes (residua) having a boiling range in excess of about 340° C. (644° F.). An example of a preferred feed material is a vacuum residuum having the properties shown in Table 1 below.

TABLE 1

| Vacuum Resid Properties | |
|---|---|
| Carbon, % | 83.6 |
| Hydrogen, % | 9.3 |
| Nitrogen, % | 0.8 |
| Oxygen, % | 0.5 |
| Sulfur, % | 5.8 |
| CCR, % | 27.3 |
| Nickel, ppm | 121 |
| Vanadium, ppm | 587 |
| Boiling Point Range, °F. | |
| 420–650° F., wt % | 0.0 |
| 650–850° F., wt % | 0.8 |
| 850–1000° F.. wt % | 10.8 |
| 1000° F.+, wt % | 62.2 |

Catalysts useful in the process of the present invention are known and include metal compounds which are thermally decomposable under process conditions such as (1) inorganic metal compounds such as halides, oxyhalides, poly acids such as isopoly acids and heteropoly acids (e.g. phosphomolybdic acid, molybdosilicic acid; (2) metal salts of organic acids such as acyclic and alicyclic aliphatic carboxylic acids (e.g. toluic acid); sulfonic acids (e.g. toluenesulfonic acid); sulfonic acids; mercaptans, xanthic acid, phenols, di and polyhydroxy aromatic compounds; (3) organometallic compounds such as metal chelates, e.g., with 1,3-diketones, ethylene diamine, ethylene diamine tetraacetic acid, phthalocyanines, carbonyls, etc.; (4) metal salts of organic amines such as aliphatic amines, aromatic amines, and quaternary ammonium compounds.

The metal constituent of the thermally decomposable metal compound, that is convertible to a solid, non-colloidal catalyst, is selected from the group consisting of Groups IVB, VIB, VIB, VIIB and VIII and mixtures thereof of the Periodic Table of Elements, in accordance with the table published by in Perry's Chemical Engineer's Handbook, Fourth Edition by McGraw Hill, copyright 1962 Dyna Slide Company, that is, titanium, zirconium, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the thermally decomposable metal compound is selected from the group consisting of molybdenum, vanadium and chromium. More preferably, the metal constituent of the thermally decomposable metal compound is selected from the group consisting of molybdenum and chromium. Most preferably, the metal constituent of the thermally decomposable compound is molybdenum. Preferred compounds of the given metals include the salts of acyclic (straight or branched chain) aliphatic carboxylic acids, salts of alicyclic aliphatic carboxylic acids, heteropoly acids, carbonyls, phenolates and organo amine salts. The more preferred metal compounds are salts of an alicyclic aliphatic carboxylic acid such as metal naphthenates. The most preferred compounds are molybdenum naphthenate, vanadium naphthenate, chromium naphthenate and phosphomolybdic acid.

When the thermally decomposable metal compound is added to the hydrocarbonaceous chargestock, it first disperses in the oil and subsequently, under pretreatment with, for example, hydrogen sulfide, or under hydroconversion conditions herein described, is converted to a solid non-colloidal catalyst comprising from about 25 to about 950 wppm (i.e., parts per million by weight), preferably from about 50 to about 300 wppm, more preferably from about 50 to about 200 wppm of the same metal or metals added as thermally decomposable compound, calculated as the elemental metal, based on the oil chargestock.

When a thermally decomposable molybdenum compound is used as the catalyst precursor, the preferred method of converting the thermally decomposable metal compound is in situ in the hydroconversion zone, without any pretreatment with hydrogen sulfide.

Hydrotreating conditions include a temperature ranging from about 700° F. to 1000° F., preferably from about 800° F. to 900° F., and at a total pressure ranging from about 100 to 5000 psig, preferably from about 500 to 3000 psig. Hydrogen is introduced into the reaction zone at a rate of about 300 to about 5000 standard cubic feet per barrel, preferably at a rate of about 500 to 1000 standard cubic feet per barrel of hydrocarbon oil. Reaction time (i.e., residence time of the feedstock in the reaction zone) may vary widely. Suitable reaction times include from about 5 minutes to about 4 hours, preferably from about 10 minutes to 2 hours depending upon the desired degree of conversion. Contact of the dispersion under the hydrotreating conditions in the reaction zone with the hydrogen-containing gas converts the metal compound to the corresponding metal catalyst in situ while simultaneously producing a hydrotreated oil. The hydrotreated oil containing solids is removed from the hydrotreating reaction zone. The solids which contain most, if not all, of the dispersed metal catalyst may be separated from the hydrotreated oil by conventional means, for example by settling or centrifuging or filtration of the slurry. At least a portion of the separated solids or solids concentrate may be recycled directly to the hydrocracking zone or recycled to the hydrocarbon oil chargestock. The process of the invention may be conducted either as a batch or as a continuous type operation.

Two Stage Hydrotreating

It has been found that hydrotreating a heavy oil in a two stage process significantly reduces coke formation. The first stage comprises "heat soaking" the hydrocarbon oil feed. Heat soaking is a relatively mild hydrotreating process which preconditions the feed. Preconditioning the feed renders it less susceptible to coking under the more severe hydrotreating conditions of the second stage of the process. Generally, coking is related to severity, i.e., the more severe the hydrotreating, the more coking results. It is particularly surprising, then, that although the overall severity of the two stage process may be high (as measured by ERT as explained below), the two stage process of the present invention achieves higher conversion and lower coking than single stage processes of equal or even lower severity. The preconditioning first stage of the present invention enables the hydrotreating second stage to achieve higher conversion and lower coking than employing the second stage without the first stage.

Referring to FIG. 1, a feedstream containing hydrocarbon oil feedstock, (e.g., a vacuum resid) is fed via line 101 to a furnace 104. Hydrogen is added via line 102 and make up catalyst (molybdenum hexacarbonyl, $Mo(CO)_6$) is added via line 103. The charge is heated to reaction temperature at which point the reaction, being exothermic, generates its own heat. The effluent from the furnace is fed via line 105 to the first stage of the two stage hydrotreating process, i.e. the heat soak stage, 106.

Heat soaking is conducted at a temperature of from about 700° F. to about 820° F., preferably from about 740° F. to about 800° F., and more preferably about 760° F. to about 790° F. Heat soaking pressure is from about 100 to about 5000 psig, preferably from about 500 to about 3000 psig, and more preferably from about 1500 to about 2500 psig. Heat soaking can be conducted for a period of time of from about 5 minutes to about 700 minutes depending on the operating temperature, and the degree of conversion desired. The effluent from the heat soak stage 106 is sent via line 107 to the hydrotreatment second stage 108. Hydrotreatment stage two may be carried out at a temperature of from about 780° to about 900° F., preferably from about 800° F. to about 860° F. and more preferably from about 820° F. to about 850° F. The pressure range may be from about 100 to about 5000 psig, preferably from about 500 to about 3000 psig, and more preferably from about 1500 to about 2500 psig. Second stage hydrotreating 108 may be conducted for a period of time of from about 5 minutes to about 700 minutes depending on the operating temperature and the degree of conversion desired.

The effluent from the second stage hydrotreating 108 is sent via line 109 to further processing including removal of ammonia, hydrogen sulfide, hydrogen, and light hydrocarbons.

Examples 7 and 9 below compare the two-stage hydrotreating process of the present invention with prior known processes as illustrated in Examples 1 to 6, 8, and 10.

Equivalent residence time ("ERT") as reported in the data which follows, is an expression of the severity of the reaction in terms of the residence time necessary to achieve equivalent severity at a standard temperature of 427° C. (800° F.). ERT is discussed in *Fuel,* vol. 69m p. 1063–1064 (August 1990), and in the *Preprints of the Division of Petroleum Chemistry,* ACS Meeting, Vol. 32, No. 2, page 490 (April 1987) by T. Y. Yan, both articles being herein incorporated by reference.

EXAMPLES 1 TO 10

The following Examples 1 to 10 employ a 975° F.+ resid feed having the properties set forth above in Table 1. The examples were carried out in a hydrotreating system as diagrammed in FIG. 1. Reaction conditions were as specified below in Table 2 for each example. The catalysts employed were selected from molybdenum hexacarbonyl, molybdenum naphthenate and nickel naphthenate. Example 6 was conducted without a catalyst. The results of examples 1 to 10 are given below in Table 2. Coke is measured as the weight percent of material which is insoluble in tetrahydrofuran (THF). Of these examples, Examples 7 and 9 were conducted in accordance with the two stage process of the present invention. Examples 1 to 6, 8 and 10 were conducted in accordance with the prior known one step process.

TABLE 2

| Hydrotreating of Resid | Example | | | | | | | | | |
|---|---|---|---|---|---|---|---|---|---|---|
| | 1 | 2 | 3 | 4 | 5 | 6 | 7 | 8 | 9 | 10 |
| Catalyst[1] | A | A | A | B | C | none | A | A | A | A |
| Molybdenum content, ppm. | 650 | 650 | 650 | 650 | — | — | 650 | 650 | 650 | 650 |
| Pressure, psig. | 2000 | 2000 | 2000 | 2000 | 2000 | 2000 | 2000 | 2000 | 2000 | 2000 |
| First stage temperature, °F. | 850 | 820 | 785 | 785 | 785 | 785 | 740 | 740 | 785 | 820 |
| Second stage temperature, °F. | — | — | — | — | — | — | 830 | — | 840 | — |
| First stage time, min. | 47 | 24 | 150 | 150 | 150 | 150 | 480 | 480 | 150 | 54 |
| Second stage time, min. | — | — | — | — | — | — | 615 | — | 60 | — |
| Gas | $H_2$ | $H_2$ | $H_2$ | $H_2$ | $H_2$ | $H_2$ | $H_2$ | $H_2$ | $H_2$ | $H_2$ |
| Gas flow, liters $H_2$/liter feed | 240 | 240 | 240 | 240 | 240 | 240 | 240 | 240 | 240 | 240 |
| Total ERT[2] at 800° F., seconds | 12395 | 3307 | 6145 | 6354 | 6421 | 6602 | 84730 | 6045 | 18371 | 6010 |
| Product Dist. Weight Percent | | | | | | | | | | |
| Gas–75 F | 15.43 | 5.81 | 6.61 | 6.77 | 7.33 | 11.10 | 14.09 | 4.03 | 5.13 | 4.30 |
| 75–400 F | 18.63 | 5.05 | 4.70 | 6.83 | 7.90 | 13.15 | 37.64 | 4.08 | 15.83 | 9.68 |
| 400–800 F | 28.83 | 30.70 | 28.44 | 34.46 | 35.10 | 30.73 | 35.79 | 25.12 | 41.76 | 34.78 |
| 800–1050 F | 6.41 | 17.77 | 19.40 | 16.19 | 17.04 | 10.36 | 4.67 | 21.26 | 14.95 | 14.16 |
| +1050 F Oil | 19.47 | 39.38 | 40.10 | 34.40 | 30.45 | 24.58 | 6.61 | 42.61 | 18.12 | 32.63 |
| Coke[3] | 11.23 | 1.29 | 0.75 | 1.35 | 2.17 | 10.08 | 1.20 | 0.73 | 1.46 | 2.27 |

TABLE 2-continued

| | Hydrotreating of Resid | | | | | | | | | |
|---|---|---|---|---|---|---|---|---|---|---|
| | Example | | | | | | | | | |
| | 1 | 2 | 3 | 4 | 5 | 6 | 7 | 8 | 9 | 10 |
| Total | 100.00 | 100.00 | 100.00 | 100.00 | 100.00 | 100.00 | 100.00 | 100.00 | 100.00 | 100.00 |
| +1050 Conv % | 65.30 | 54.02 | 54.24 | 59.59 | 63.12 | 60.82 | 91.17 | 51.01 | 77.87 | 60.55 |
| CCR Conversion % | 66.79 | 22.07 | 39.45 | 35.00 | 35.00 | 32.88 | 83.75 | 40.00 | 63.00 | 32.00 |

[1]Catalyst A = molybdenum hexacarbonyl, $Mo(CO)_6$ Catalyst B = molybdenum naphthenate Catalyst C = nickel naphthenate (650 ppm Ni)
[2]Equivalent residence time
[3]Tetrahydrofuran insolubles Comparing Example 7 with Examples 8, 10, and 2 one observes that the two step process of Example 7 (first stage 740° F.; second stage 830° F.) results in a coke production of only 1.2 weight percent of products with a conversion level of 91.17% for the 1050° F.+ fraction. Example 10 at a single stage temperature of 820° F. resulted in a 60.55% conversion with 2.27% coking. Example 8 at a single stage temperature of 740° F. had low coking (0.73%) but also low conversion. Example 2 conducted at 820° F. for 24 minutes was characterized by a much lower ERT severity and lower conversion than that of Example 7, and yet Example 2 exhibited a higher coking level. Thus, the two-stage process of Example 7 resulted in higher conversion, and less coking than the single stage hydrotreating process under less severe conditions.

Comparing the two stage process of Example 9 with Examples 3 and 10, one observes that the two stage process of Example 9 resulted in a conversion of 77.87% with only 1.46% coking whereas the single step process of Example 3 (at 785° F.) resulted in only 54.24% conversion with 0.75% coking, and the single step process of Example 10 resulted in only 60.55% conversion with 2.27% coking.

The low coking of the two stage process of the present invention is especially surprising in light of the higher coking of the one step process.

Product Filtration with Backflushing

Recycling of a catalyst is achieved by filtering the product of the hydrotreating reaction and backflushing the filters periodically to generate a recycle stream containing coke and catalyst particles. The recycled coke contains catalyst and has about 60–70% of the catalyst activity of the fresh catalyst from which it was generated.

Figure 2:
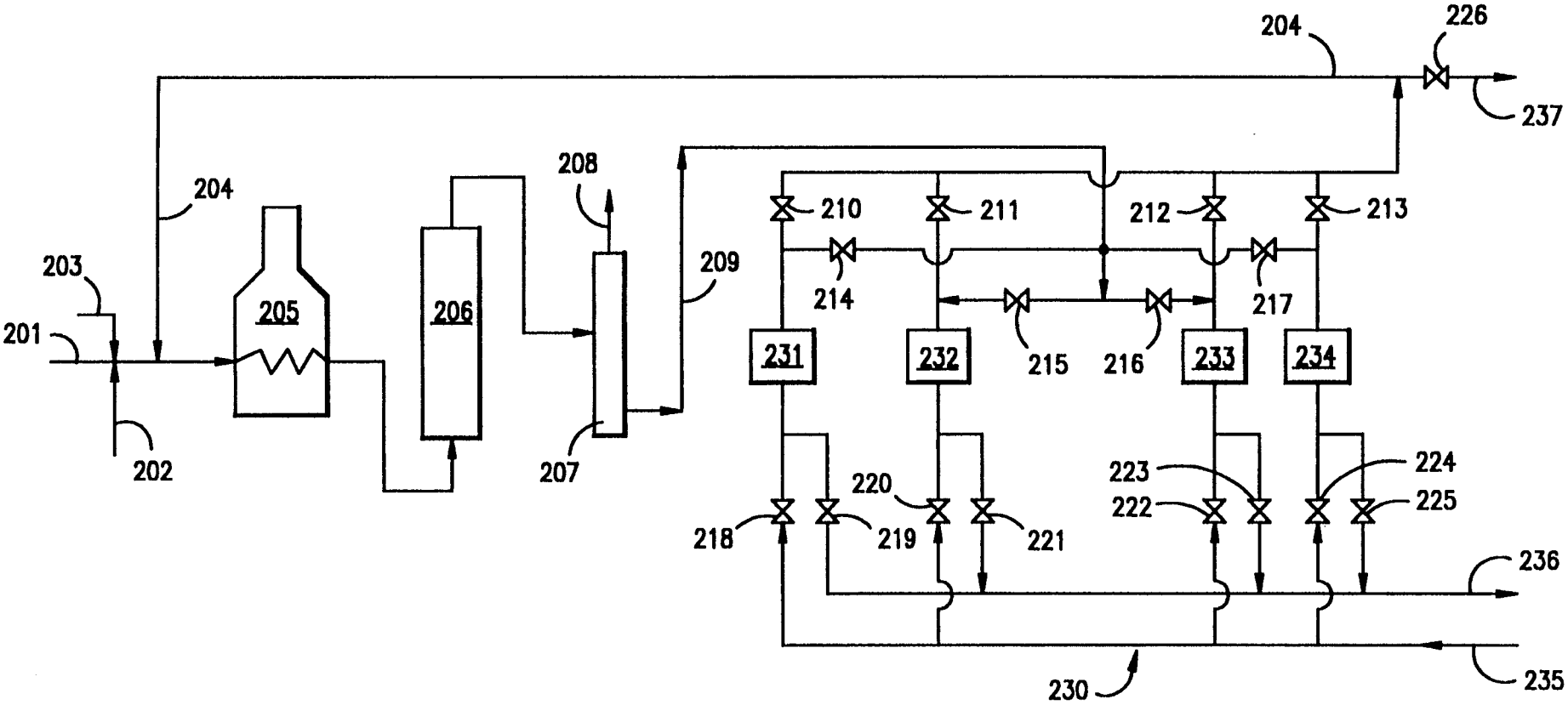
FIG. 2 is a flowchart illustrating the product filtration with backflushing process of the present invention.

FIG. 2 is a flow diagram of a hydrotreating process including the backflushing and recycle system of the present invention.

A feed stream 201 containing petroleum residue or any of the other feedstocks discussed earlier, is sent to a furnace 205 with added hydrogen, stream 203, and makeup catalyst, stream 202. After heating the feed is sent to reactor 206 for conversion. The effluent from the reactor is sent to degasser 207 wherein hydrogen sulfide, ammonia, hydrogen and light hydrocarbons are removed via stream 208. The degasser effluent 209 is then sent to the filtration and recycle system 2–3 of the present invention. The system is preferably divided into two sections so that one section can be operated in a filling cycle while the other section is being backflushed. The cycles can then be alternated. Stream 235 is a flush oil from product separation. Stream 236 is the filtered product. The backflush stream is directed to stream 204 for recycle to the reactor, or through valve 226 to a net coke product stream 237. In operation the valves are opened or closed to alternate filtration and backflushing cycles. In cycle 1, filtration units 231 and 232 are in a filtration cycle while filtration units 233 and 234 are being backflushed with flush oil from stream 235. In cycle two filtration units 231 and 232 are backflushed and filtration units 233 and 234 are in a filtration cycle. The valves are opened or closed according to the following schedule:

| Valve | Cycle 1 | Cycle 2 |
|---|---|---|
| 210 | closed | open |
| 211 | closed | open |
| 212 | open | closed |
| 213 | open | closed |
| 214 | open | closed |
| 215 | open | closed |
| 216 | closed | open |
| 217 | closed | open |
| 218 | closed | open |
| 219 | open | closed |
| 220 | closed | open |
| 221 | open | closed |
| 222 | open | closed |
| 223 | open | closed |
| 224 | closed | open |
| 225 | closed | open |

The following examples illustrate a hydrotreating process with the filtration system of the present invention.

EXAMPLES 11, 12 AND 13

A feed of vacuum resid having the properties shown in Table 1 was hydrotreated in a system as shown in FIG. 2. In Example 11, hydrogen stream 203 was employed, but no catalyst (i.e. no stream 202) and no recycle (no stream 204). In Example 12, hydrogen stream 203 and fresh catalyst stream 202 were employed, but without recycle stream 204. Unlike Examples 11 and 12, Example 13 was performed in accordance with the backflushing method of the present invention and all three streams 202, 203, 204 were employed. When catalyst stream 202 was in operation (Examples 12 and 13) the catalyst employed was 325 ppm molybdenum as molybdenum hexacarbonyl. The effluent of hydrotreater 206 was analyzed and the relative contents of the stream at the hydrotreater outlet were determined. The results are set forth below in Table 3.

TABLE 3

HYDROCRACKING WITH DISPERSED CATALYST-COKE RECYCLE

| | Example | | |
|---|---|---|---|
| | 11 | 12 | 13 |
| Autoclave Conditions | 785° F. 252 min. 2000 psig $H_2$ | 785° F. 252 min. 2000 psig $H_2$ | 780° F. 252 min. 2000 psig $H_2$ |
| Catalyst- | None | 325 ppm Mo as $(CO)_6$ Mo | Recycled Coke and Mo |
| Product | | | |

TABLE 3-continued

| HYDROCRACKING WITH DISPERSED CATALYST-COKE RECYCLE | | | |
|---|---|---|---|
| | Example | | |
| | 11 | 12 | 13 |
| Fraction | Wt. % of Fraction in Product | | |
| Gas (<75° F.) | 10.4 | 7.9 | 11.5 |
| 75–400° F. | 13.9 | 6.3 | 6.0 |
| 400–800° F. | 30.7 | 32.9 | 35.1 |
| 800–1050° F. | 10.3 | 18.2 | 16.5 |
| 1050° F.+ | 24.6 | 33.7 | 28.2 |
| COKE | 10.1 | 1.5 | 3.7 |

As can be seen from the results set forth in Table 3, backflushing and recycling the catalytically active filtered coke product (Example 13) achieves greater conversion of the 1050° F.+ boiling fraction than by using the catalyst without recycle (Example 12), with much lower coke production as compared with Example 11. Example 13 also shows the highest production of the economically desirable 400° to 800° F. fraction.

Solvent Deasphalting

Demetallation of low quality vacuum resid is achieved by hydrotreating the resid in the presence of a dispersed metal catalyst and then deasphalting the product with a highly paraffinic solvent. The asphaltic fraction of the hydrotreating effluent represents about 10% to 15% of the original feed, but contains about 98% to 99% of the nickel and vanadium compounds present in the resid. Thus the metals can be concentrated into a relatively small volume of the product.

The hydrotreating can be relatively mild since the method of the present invention obviates the need for high conversion to achieve efficient demetallation. The asphaltic fraction, which is insoluble in the paraffinic solvent, may be recovered from the product as a low volume, low value stream. This asphaltic fraction can be burned, incinerated, gasified, coked, or disposed of in an environmentally acceptable way. The metals may be recovered.

The lighter liquid and gaseous products from the initial processing would then be fed to other refinery units for upgrading to a high yield of higher value products. Thus the combination of two relatively mild and inexpensive processes, i.e. mild hydrotreating and mild solvent deasphalting, can provide a way to achieve high yields of light liquid products from relatively low value, high metals content residue.

Figure 3:
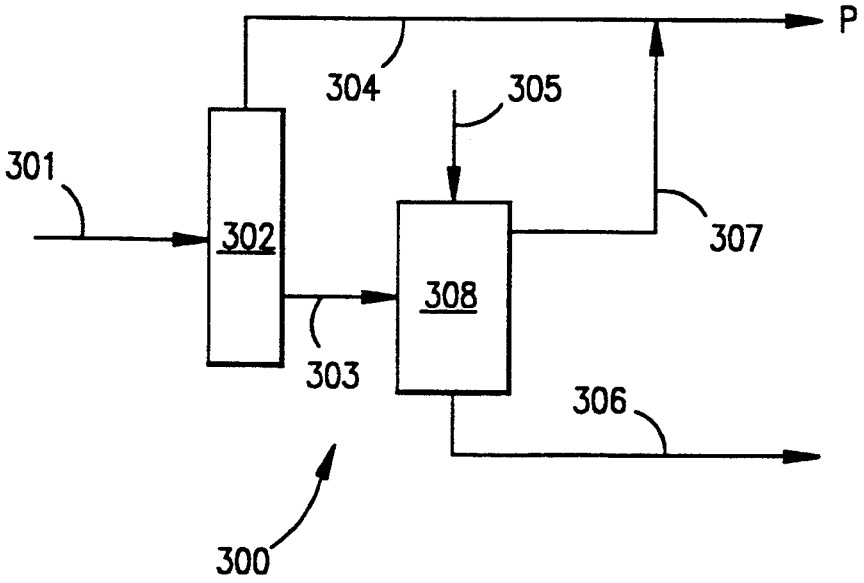
FIG. 3 is a flowchart illustrating the solvent deasphalting process of the present invention.

Referring to FIG. 3, the solvent deasphalting process of the present invention 300 is diagrammatically illustrated. Stream 301 is the effluent from a hydrotreating process. The hydrotreating condition can range from mild to severe although mild hydrotreating is preferred.

Mild hydrotreating conditions include a temperature range of about 700° F. to about 820° F.; a pressure range of from about 500 psig to about 3000 psig; a hydrogen rate of from about 300 to about 5000 cubic feet per barrel of hydrocarbon oil; and reaction times of from about 5 minutes to about 500 minutes. Mild conversion levels range from about 25% to 70%.

Effluent 301 is sent to a separation unit 302 to achieve a separation of the effluent into light and heavy fractions. A fractionator may be used to achieve simple separation. The light fractions are removed via stream 304. The heavy fractions are sent via stream 303 to solvent deasphalter 308. A stream of paraffinic solvent, e.g. $C_7H_{16}$ hydrocarbons, is added to deasphalting unit 308 via stream 305. The asphaltic fraction, which is insoluble in $C_7$ paraffinic hydrocarbons, is removed via stream 306. The $C_7$ soluble fraction is removed via stream 307 and added to stream 304 to form a product stream P. The asphaltic stream 306 may be sent for incineration, gasification or other processing.

The following Examples 14 and 15 illustrate the solvent deasphalting process of the present invention. In both examples a vacuum resid was employed as the feedstock. Example 16 illustrates the less efficient demetallation achieved through solvent deasphalting of the virgin (unhydrotreated) resid alone.

EXAMPLES 14, 15 and 16

A vacuum resid having properties as set forth in Table 1 was hydrotreated and deasphalted under the conditions as set forth in Table 4 below.

TABLE 4

| HYDROTREATING CONDITIONS | | | |
|---|---|---|---|
| | Example 14 | Example 15 | Example 16 |
| Temperature | 820° F. | 780° | no hydrotreating |
| Pressure | 2000 psig $H_2$ | 2000 psig $H_2$ | |
| Time | 50 min. | 280 min. | |
| The weight distribution of hydrotreating effluent fractions is given below in Table 5. | | | |

TABLE 5

| HYDROTREATING EFFLUENT PRODUCT DISTRIBUTION (Weight Percent) | | | |
|---|---|---|---|
| | Example 14 | Example 15 | Example 16 |
| Gas (<75° F.) | 8.00 | 9.08 | No hydrotreating before deasphalting |
| 75–400° F. | 11.40 | 5.19 | |
| 400–800° F. | 34.90 | 32.69 | |
| 800–1050° F. | 14.75 | 17.19 | |
| 1050° F.+ | 28.46 | 34.75 | |
| COKE | 2.49 | 1.10 | |

The 1050° F.+ fraction of each example was then deasphalted with n-heptane. The resulting product distributions of the deasphalted fractions are set forth below in Table 6 which shows that of the total product, 13.94 wt. % is insoluble in paraffinic solvent in Example 14, and 24.23 wt. % is insoluble in paraffinic solvent in Example 15.

TABLE 6

| PRODUCT DISTRIBUTION OF DEASPHALTED 1050° F.+ FRACTION (Weight percent based on total product) | | | |
|---|---|---|---|
| | Example 14 | Example 15 | Example 16 |
| n-$C_7$ soluble | 14.52 | 10.52 | 73.71 |
| n-$C_7$ insoluble | 13.94 | 24.23 | 26.29 |
| The distribution of contaminant metals, i.e. Ni and V, is set forth in Table 7, below. | | | |

TABLE 7

| METAL DISTRIBUTION (Weight percent of total metals content) | | | | | | |
|---|---|---|---|---|---|---|
| | Example 14 | | Example 15 | | Example 16 | |
| Metal | Metals in $C_7$ solubles | Metals in $C_7$ insolubles | Metals in $C_7$ solubles | Metals in $C_7$ insolubles | Metals in $C_7$ solubles | Metals in $C_7$ insolubles |
| Ni | 2% | 98% | <1% | 99+% | 35% | 65% |
| V | 1% | 99% | <1% | 99+% | 24% | 76% |

The above Table 7 shows that about 98% to 99% of the contaminant metals are contained in the $C_7$ insolubles, i.e. asphalt stream. If the resid is not hydrotreated there is more asphalt, but it contains only 35% and 24%, respectively of the Ni and V metal contaminants. The atomic weight percent composition of the $C_7$ insoluble stream as compared with that of the vacuum resid feedstock is set forth in Table 8.

TABLE 8

| | (Atomic weight percent composition) | | | |
|---|---|---|---|---|
| | Feed | Example 14 $C_7$ insolubles | Example 15 $C_7$ insolubles | Example 16 $C_7$ Insolubles |
| Carbon wt % | 83.6 | 84.5 | 85.07 | 82.02 |
| Hydrogen wt % | 9.3 | 5.00 | 5.02 | 7.25 |
| Oxygen wt % | 0.5 | 1.93 | 2.02 | 1.89 |
| Nitrogen wt % | 0.8 | 2.46 | 2.08 | 1.29 |
| Sulfur wt % | 5.8 | 5.84 | 4.18 | 7.56 |

The data in the above Tables 4 to 8 indicate that mild hydrotreating drives almost all of the metal contaminants present in the virgin vacuum residue into the asphaltic fraction of the resid, i.e. compounds which are insoluble in paraffinic solvents. Thus the asphalt stream, which is only 13 to 24 wt. % of the raw resid contains 98 to 99+% of the metals.

The total liquid product (75°–1050° F.), which is soluble in the paraffinic solvent, is about 65.6 to 75.6 wt. % of the raw resid and contains from <1% to about 2% of the metals. Deasphalting without hydrotreating (i.e. Example 16) results in very inefficient demetallation.

Combined Processes

The aforementioned embodiment of the invention, i.e., two-stage hydrotreating, product filtration with backflushing, and solvent deasphalting may be combined in various arrangements.

Figure 4:
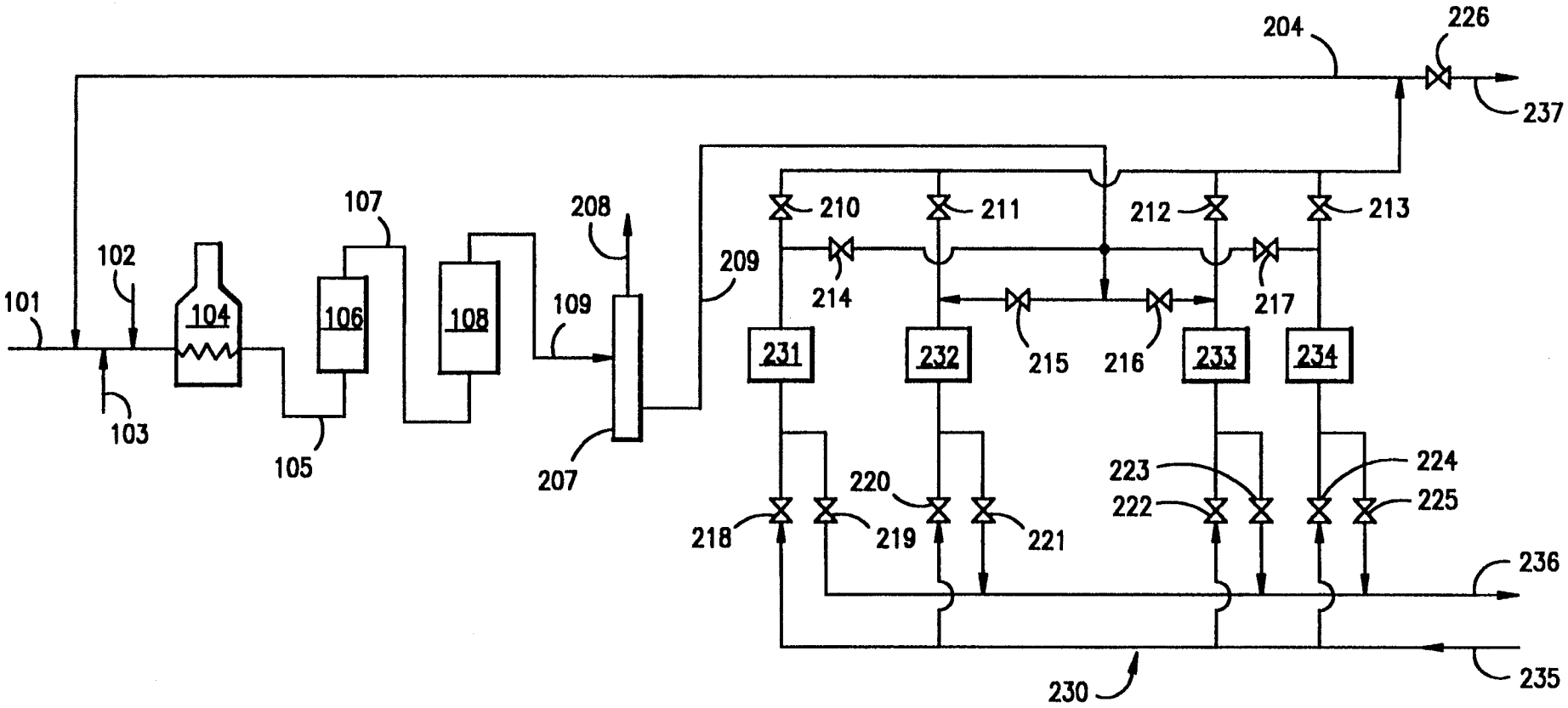
FIG. 4 is a flowchart illustrating two-stage hydrotreating used in conjunction with product filtration with backflushing and recycle.

FIG. 4 illustrates two-stage hydrotreating used in conjunction with product filtration with backflushing and recycle.

Figure 5:
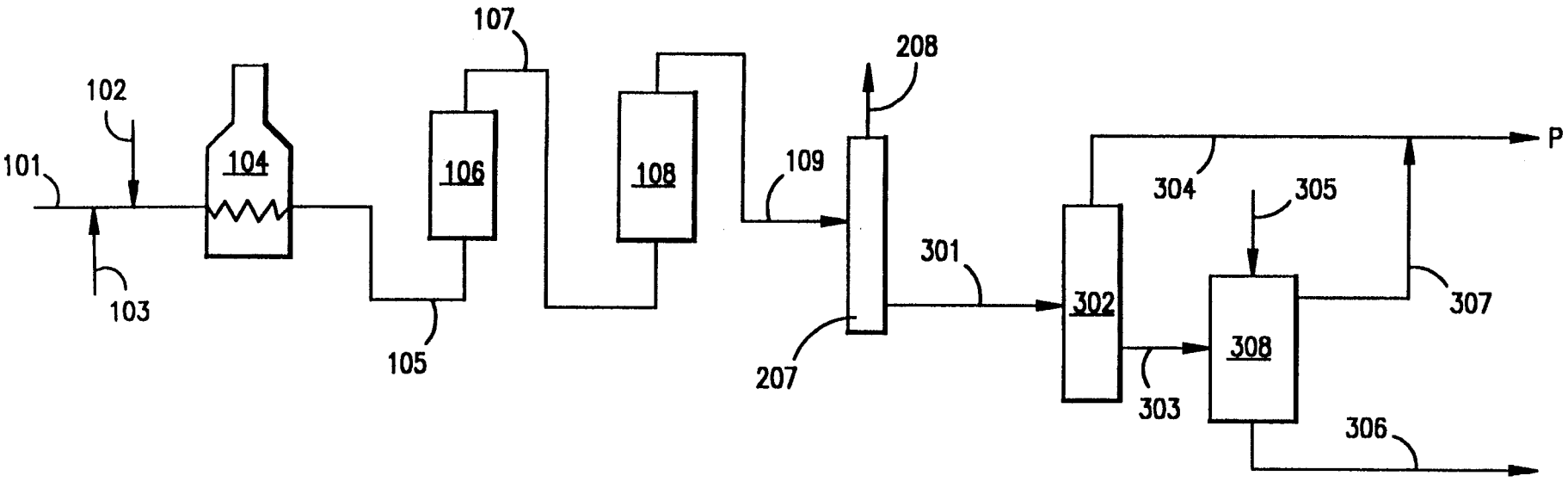
FIG. 5 is a flowchart illustrating two-stage hydrotreating used in conjunction with solvent deasphalting.

FIG. 5 illustrates two-stage hydrotreating used in conjunction with solvent deasphalting.

Figure 6:
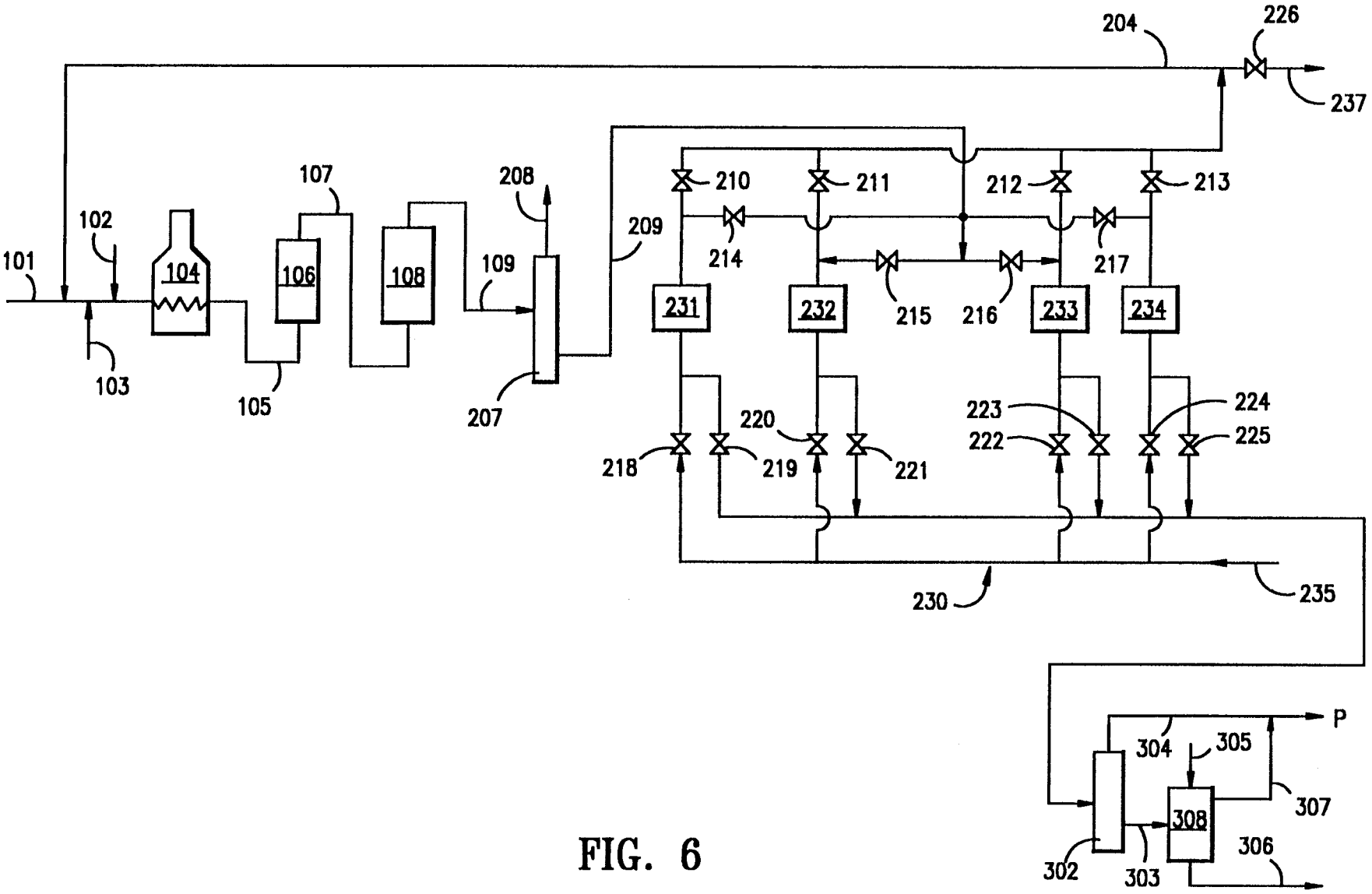
FIG. 6 is a flowchart illustrating two-stage hydrotreating used in conjunction with both product filtration with backflushing and recycle and solvent deasphalting.

FIG. 6 illustrates two-stage hydrotreating used in conjunction with both product filtration with backflushing and recycle and with solvent deasphalting.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A process for hydrotreating a hydrocarbon oil comprising:

a) contacting said hydrocarbon oil with a hydrotreating catalyst under relatively mild first stage hydrotreating conditions in a first reaction zone to provide a preconditioned oil; and then b) directly transferring substantially the entire amount of said preconditioned oil from said first reaction zone to a second reaction zone;

c) contacting said preconditioned oil with a hydrotreating catalyst in said second reaction zone under second stage hydrotreating conditions which are more severe than said first stage conditions to provide a hydrotreated oil product, the overall amount of coking occurring in said process being significantly less than the amount of coking occurring in a single stage hydrotreating process achieving equivalent overall severity, wherein said first stage hydrotreating conditions include a temperature of from about 700° F. to about 820° F., a pressure of from about 100 psig to about 5000 psig, and a reaction time of from about 5 minutes to about 200 minutes, and said second stage hydrotreating conditions include a temperature of from about 780° F. to about 900° F., a pressure of from about 100 psig to about 5000 psig and a reaction time of from about 5 minutes to about 700 minutes.

2. The process of claim 1, wherein said first stage hydrotreating conditions include a temperature of from about 740° F. to about 800° F., a pressure of from about 500 psig to about 3000 psig, and a reaction time of from about 10 minutes to 500 minutes and said second hydrotreating stage conditions include a temperature of from about 800° F. to about 860° F., a pressure of from about 500 psig to about 3000 psig, and a reaction time of from about 10 minutes to about 615 minutes.

3. The process of claim 1, wherein said first stage hydrotreating conditions include a temperature of from about 760° F. to about 790° F. a pressure of from about 1500 psig to about 2500 psig, and a reaction time of from about 20 minutes to about 480 minutes, and said second stage hydrotreating conditions include a temperature of from about 820° F. to about 850° F., a pressure of from about 1500 psig to about 2500 psig, and a reaction time of from about 20 minutes to about 615 minutes.

4. The process of claim 1, wherein said hydrocarbon oil is selected from the group consisting of crude oil, petroleum residue, coal oil, shale oil, and tar oil.

5. The process of claim 1, wherein said catalyst is selected from the group consisting of molybdenum hexacarbonyl, molybdenum naphthenate, and nickel naphthenate.

6. The process of claim 1, further comprising contacting said fully hydrotreated oil product with a solvent for separating said hydrotreated oil into an asphaltic fraction and a residue product fraction.

7. The process of claim 6, wherein said solvent is a paraffinic solvent.

8. The process of claim 7, wherein said paraffinic solvent is n-heptane.

9. The process of claim 1, further comprising filtering said hydrotreated oil product through at least one filter to remove particles containing coke and catalyst, backflushing said at least one filter with a flush oil to create a recycle stream of said particles carried by said flush oil and a filtered oil stream, and recycling said recycle stream to said feedstock.

10. The process of claim 9, further comprising contacting said filtered oil with a solvent for separating said filtered oil into an asphaltic fraction and a residue product fraction.

11. The process of claim 10, wherein said solvent is a paraffinic solvent.

12. The process of claim 11, wherein said paraffinic solvent is n-heptane.

13. A process for hydrotreating a hydrocarbon oil feedstock comprising:

a) passing a hydrotreated oil containing coke and hydrotreating catalyst particles through at least one filter to remove coke and catalyst particles from the oil;

b) backflushing the filter with a flush oil to create a recycle stream of said particles carried by said flush oil; and c) recycling said recycle stream to hydrotreating feedstock.

14. The process of claim 13, wherein said hydrotreated oil is selected from the group consisting of crude oil, petroleum residue, coal oil, shale oil, and tar oil.

15. The process of claim 13, wherein said hydrotreating catalyst is selected from the group consisting of inorganic halides inorganic oxyhalides, inorganic polyacids, metal salts of organic acids, organometallic compound and metal salts of organic amines.

16. A process for demetallation of a hydrocarbon oil comprising:

a) dispersing a catalyst within said hydrocarbon oil to create a hydrotreating feedstock;

b) contacting said hydrotreating feedstock with hydrogen under hydrotreating conditions to form a hydrotreated hydrocarbon oil mixture containing a hydrotreated residue fraction, wherein said hydrotreating conditions comprise a temperature of from about 700° F. to about 900° F., a pressure of from about 100 psig to about 5000 psig and a reaction time of from about 5 minutes to about 700 minutes;

c) separating said hydrotreated residue fraction; and d) contacting said hydrotreated residue fraction with a solvent for separating said hydrotreated residue fraction into an asphaltic fraction and a residue product fraction, said asphaltic fraction containing at least about 90% of the metal content of the original hydrocarbon oil.

17. The process of claim 16, wherein said hydrocarbon oil is selected from the group consisting of crude oil, petroleum residue, coal oil, shale oil, and tar oil.

18. The process of claim 16, wherein said catalyst is selected from inorganic halides inorganic oxyhalides, inorganic polyacids, metal salts of organic acids, organometallic compounds, and metal salts of organic amines.

19. The process of claim 16, wherein said solvent is a paraffinic solvent.

20. The process of claim 19, wherein said paraffinic solvent is n-heptane.

21. The process of claim 16 wherein said hydrotreating conditions comprise a temperature of from about 700° F. to about 820° F., a pressure of from about 500 psig to about 3000 psig, a reaction time of from about 5 minutes to about 500 minutes, and a hydrogen rate of from about 300 to 5000 cubic feet per barrel of hydrocarbon oil.

* * * * *